United States Patent [19]

Gray

[11] Patent Number: 4,876,779

[45] Date of Patent: Oct. 31, 1989

[54] APPARATUS AND METHOD FOR MANUFACTURING PLATE FIN COILS OF DIFFERENT CONFIGURATIONS

[75] Inventor: Kenneth P. Gray, Syracuse, N.Y.

[73] Assignee: Carrier Corporation, Syracuse, N.Y.

[21] Appl. No.: 118,380

[22] Filed: Nov. 6, 1987

[51] Int. Cl.[4] ..... B21D 53/02

[52] U.S. Cl. ..... 29/157.3 R; 29/157.3 C; 29/157.4; 29/523; 29/727

[58] Field of Search ..... 29/157.3 C, 157.3 B, 29/157.3 R, 157.4, 727, 523; 269/45, 309, 900, 88

[56] References Cited

U.S. PATENT DOCUMENTS

| | | | |
|---|---|---|---|
| 3,487,523 | 1/1970 | Ames | 29/523 |
| 3,824,668 | 7/1974 | Wightman | 29/727 |
| 4,459,917 | 7/1984 | Michael et al. | 29/157.3 C |
| 4,475,727 | 10/1984 | Goulter | 269/88 |
| 4,512,560 | 4/1985 | Mölzer et al. | 269/45 XR |
| 4,539,738 | 9/1985 | Antol et al. | 269/309 XR |
| 4,584,751 | 4/1986 | Gray et al. | 29/157.3 C |
| 4,584,765 | 4/1986 | Gray | 29/157.3 C |
| 4,720,920 | 1/1988 | Gray | 29/157.3 C |
| 4,734,969 | 4/1988 | Cunier et al. | 29/157.3 C |

*Primary Examiner*—Howard N. Goldberg
*Assistant Examiner*—Irene Cuda
*Attorney, Agent, or Firm*—Robert H. Kelly

[57] ABSTRACT

A method and apparatus for expanding copper and aluminum tubes in either compression expansion or tension expansion which is adjustable to expand different configurations of coils on row at a time.

7 Claims, 2 Drawing Sheets

APPARATUS AND METHOD FOR MANUFACTURING PLATE FIN COILS OF DIFFERENT CONFIGURATIONS

BACKGROUND OF THE INVENTION

This invention relates generally to heat exchanger coils and, more particularly, to a method and apparatus for expanding and belling many different configurations of plate fin heat exchanger coils having either copper or aluminum tubes.

A plate fin heat exchanger coil is commonly constructed with a plurality of flat, parallel plates having laterally spaced holes therein for receiving refrigerant tubes, or hairpin tubes, therein. At each end of the plate fin bundle, there is a tube sheet composed of heavier material, and adjacent the upper tube sheet, the open ends of the hairpin tubes are fluidly connected by way of U-shaped return bends that are secured thereto by way of soldering or the like. When the coils are installed into a refrigeration system, the refrigerant is made to flow through the hairpin tubes, and the air to be cooled or heated is made to flow over the plate fins, such that a heat transfer is thereby affected.

As known, the tube compression expansion process is generally carried out by expanding the entire coil at one time by passing tube expanding rods through the open ends of the hairpin tubes and then belling the tube. A backing plate is placed against the hairpin tube bends during compressive expansion to prevent the tubes from being driven out of the unit as the expanding tools are forced therethrough. As a result of this holding action the tubes are compressed rearwardly as they are being expanded outwardly by the tools. This in turn, causes the tubes to shrink so that the axial length of each tube can vary dramatically in final assembly. Because of the differences in tube length, belling of the tubes is difficult and generally results in uneven or misaligned bells being formed in the tube ends. The return bend therefore cannot be properly seated within the bells leading to the formation of relatively weak or incomplete solder joints in this critical region.

In order to better facilitate the formation of the tube bells and the joining of the return bends therein, it has been the common practice in the art to bring the open ends of the hairpins a considerable distance out from the adjacent tube sheet. The additional length of tube allows each bell to be brought to full depth without interference from the tube sheet and also permits the return bend joint to be completely immersed in a solder bath, if the tube is aluminum, to insure that solder will flow into the entire joint region without wetting the tube sheet. The unsupported length of tube between the bell and the tube sheet, however, represents the weakest section in the unit. Hydrostatic tests have shown that the flow circuit will generally rupture in this region when exposed to high internal stresses. Beyond weakening the unit the added length of tubing wastes costly material and thus raises the cost of each unit. Furthermore, the added tube length makes it difficult to compact the unit which in the case of a room air conditioner is of primary importance.

In order to improve the hydrostatic burst strength of a plate fin heat exchanger, a technique for tension expanding hairpin tubes into a fin pack unit, as explained in greater detail in U.S. Pat. No. 4,584,765 was developed. This prior technique was generally carried out on a coil which was first belled by a split collet and pin arrangement, and then expanded. Because of the closeness of the heat exchanger tube rows the bells that were formed are simple, single diameter bells. Further, because of the closeness of the heat exchanger tube rows, the jaw members of the tue clamping fixture were relatively long, thin members. In operation, however, these long, thin jaw members bowed or bent in the transverse direction to the direction of the movement of the expanding bullet during the expansion process. Furthermore, the single diameter bell was not suitable for ultrasonic soldering, but had to use pretinned return bends. Thus, to use ultrasonic soldering, the bell diameter would have had to be increased, which would have required even less space between adjacent tubes, making the jaw member even thinner and subject to more bowing.

The major disadvantage, however, of the prior belling and expanding devices is that they were not very flexible in manufacturing coils of different configurations. As a consequence, the manufacture of a variety of different coils is time consuming and costly due to the set-up time necessary to change from one coil configuration to another coil configuration.

Thus, there is a clear need for an expander of the compression type or tension type which is very flexible in that through automatic or quick manual changes, many different configurations of plate fin coils having either copper or aluminum tubes can be manufactured.

SUMMARY OF THE INVENTION

It is an object of the present invention to improve the apparatus for manufacturing plate fin heat exchangers of various configurations.

It is another object of the present invention to provide an improved method and apparatus for belling and expanding multirow coils at a single station.

It is a further object of the present invention to minimize the amount of space and equipment needed for the belling and expanding of plate fin heat exchangers of various configurations.

It is still a further object of the present invention to expand any coil of any size, in either tension or compression, having either copper or aluminum tubes, and having either straight or hairpin tubes.

These and other objects of the present invention are attained by means of a programmable coil expander of the compression type or tension type which is very flexible in that many different configurations of coils can be made. The present invention includes an adjustable table means for supporting various size coils and a belling and expanding means for belling the open ends of tubes and expanding the tubes into a fin pack unit. The present invention has a means for vertically moving the adjustable table means from a belling station to an expanding station, an adjustable end tool carriage means for adjusting the belling and expanding stations for different length coils, an expander rod carriage means with lock-out means for expanding fin pack units of different configurations a single row at a time.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

Other objects and advantages of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERRED EMBODIMENT

Figure 1:
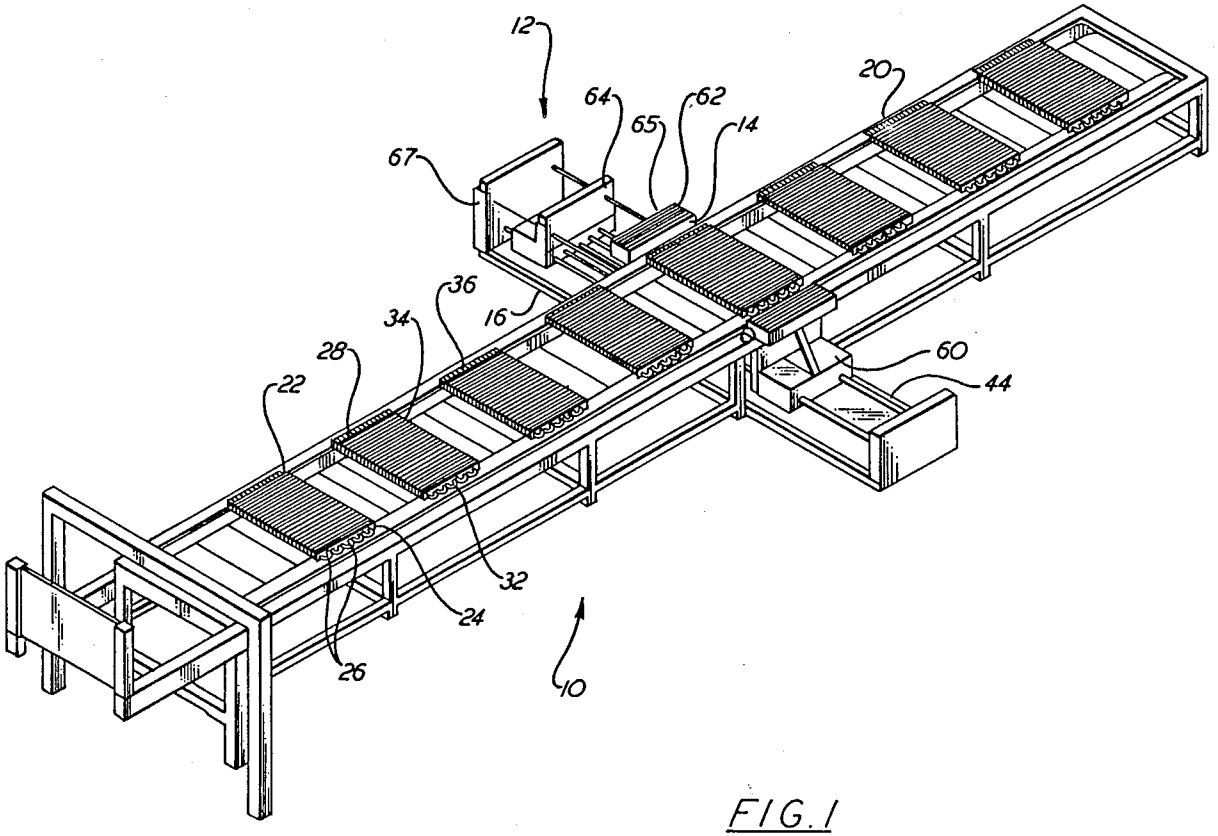
FIG. 1 is a perspective view of the apparatus embodying the teachings of the present invention.

Referring to FIG. 1, there is shown a portion of a plate fin heat exchanger assembly system 10 with the various components used in accordance with the method and apparatus of the present invention. The present plate fin coil manufacturing apparatus is described in connection with expander and beller station 12. Prior to arriving at the expander/beller station 12, the plate fin heat exchangers 20 are partially assembled at a lacing station (not shown). As may be seen a plate fin heat exchanger has a plurality of fins 26, a bottom tube sheet 24 and a top tube sheet 22. Hairpin tubes 28 are arranged having a return portion 32 and leg portions 34 such that the leg portions extend through the entire fin bundle from tube sheet 24 to tube sheet 22 and extend beyond tube sheet 22 defining extension portions 36. The hairpin tubes are physically inserted or laced through arranged openings in the fins and tube sheets into the positions as shown. Straight tubes may also be used in making the heat exchanger, however, return bends must be connected at both ends to complete the circuit.

Expander/beller station 12, shown in FIG. 1, includes a plurality of beller tools 14 secured to the upper portion 65 of front end tool carriage 62 and a plurality of bullet rods 16 which are movable through the lower portion 66 of tool carriage 62 and are actuated by a power source such as hydraulic cylinder 63 located under the rod carriage for displacing the bullet rods. Generally, one bullet rod corresponds to each leg portion of the hairpin tube in one row such that all of the tubes in the row may be simultaneously expanded. Moreover, at the expander/beller station 12, a rod locking member 67 associated with each bullet rod 16 allows the bullet rods to be locked out against movement according to the coil width and the tube spacing in any row. Back end tool carriage 60 and front end tool carriage 62 move on rail 44 to allow for different heat exchanger lengths. The back end tool carriage includes a plurality of tools 76, e.g. hairpin receivers for supporting the bend ends of hairpin tubes therein during compression. The hairpin receivers may be replaced with beller tools similar to tools 14 for belling one end of a straight tube heat exchanger.

Figure 2:
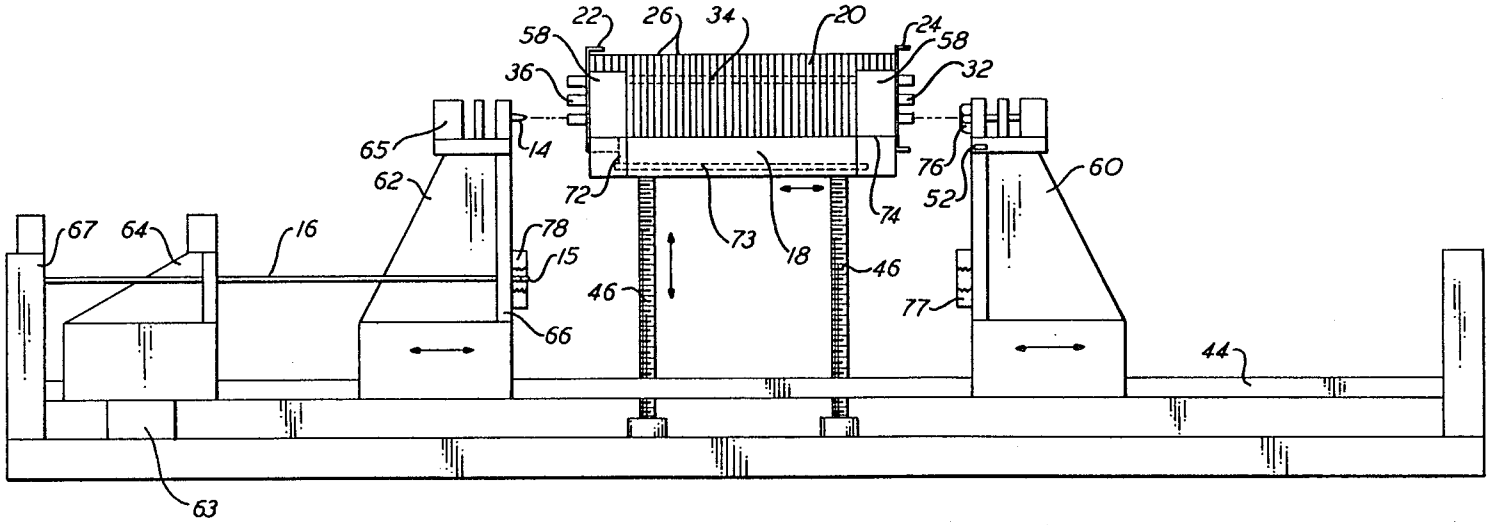
FIG. 2 is a side elevation view of a belling and expanding station embodying the teachings of the present invention.

As illustrated in FIG. 2 the previously laced plate fin heat exchanger 20 is placed on an adjustable platform 18 with the tube sheets 22, 24 positioned to overhang the end of the platform. The platform 18 has a fixed end 72 adjacent the top tube sheet 22. The platform further has an adjustable end 74 adjacent the bottom tube sheet 24 which is actuated by a suitable means such as a scissors link 73, thus leaving the back end of the coil open for, access to the tooling while adjusting the platform for different heat exchanger lengths. Adjustable side clamps 58 are carried on the platform 18. Each of the side clamps 58 is movably mounted on the platform to adjust for different width heat exchangers. As further shown in FIG. 2, platform 18 has vertical jack means 46 for moving the heat exchanger 20 from the belling station to the expanding station.

In operation, the partially assembled plate fin heat exchanger 20 is conveyed from a lacing station and is indexed into the expander/beller station 12 by index means 52, e.g. a microswitch. With the heat exchanger indexed on the platform 18 within the station 12 the length of the platform 18 is set according to the length of the heat exchanger by moving adjustable end 74 so that the tube sheets 22, 24 extend over the ends of the platform, and the side clamps 58 are set according to the width of the heat exchanger. The back end tool carriage 60 is then moved along rail 44 so that the hairpin bend end portions 32 of a single horizontal row of tubes is received in hairpin bend retainer 76, and then front end tool carriage 62 is moved along the rail and the front of the heat exchanger is belled one row at a time by the plurality of beller tools 14 moved by tool carriage 62. The platform 18 is moved vertically from one coil row to the next horizontal row by jack means 46 until all the rows are belled. The belled heat exchanger is then moved out of the belling portion of the station 12 by returning the tool carriages 60, 62 to the open position and is lowered by the jack means 46 to the expanding portion of the station. Again, the heat exchanger is indexed into the expander portion of the station, wherein either each hairpin bend end portion of each row of the coil is received in expander retainer/gripper 77 for compression expansion, or each extension portion 36 of each row of the coil is gripped by bell gripper 78 for tension expansion, and the appropriate bullet rods 16 are selected using a lock-in/lock-out mechanism of the locking member 67 so that the heat exchanger is expanded one row at a time by expanding each tube in a row into the tube sheets 22, 24 and the fins 26. Locking member 67 allows the selection of the appropriate expander rods 16 to be used with different coils. In this way, no special provisions are necessary to accommodate heat exchanger coils with different row spacing since the present invention bells and expands one row at a time. Further, no special provisions are necessary to accommodate either copper or aluminum tubes since, the present invention expands tubes in either tension or compression. Further, since aluminum hairpin tubes grow in length during expansion, retainer/gripper 77 is used as a retainer with aluminum tubes if it is desired to prevent any tube length change, or since copper hairpin tubes shrink during expansion, retainer/gripper 77 is used as a gripper if it is desired to prevent any tube length change.

While a preferred embodiment of the present invention has been depicted and described, it will be appreciated by those skilled in the art that many modifications, substitutions, and changes may be made thereto without departing from the true spirit and scope of the invention. For example, although the invention has been described in terms of use with bell retainers, it my also be used with tube sheet clamps.

What is claimed is:

1. A method of belling and expanding a partially assembled multi-row plate fin heat exchanger having a plurality of sheets of plate fins and at least one tube sheet laced with a plurality of tubes having front and back ends which comprises the steps of:

indexing the partially assembled plate fin heat exchanger in a belling station on a vertically movable dimensionally adjustable platform;

setting the length and width dimensions of said vertically movable dimensionally adjustable platform to generally conform with the size of the partially assembled plate fin heat exchanger and adjusting a side clamp means to the width of the partially assembled plate fin heat exchanger for clamping the sides of the heat exchanger with the tube sheet extending beyond the dimensions of said platform;

belling the open ends of the partially assembled multi-row heat exchanger one row at a time;

moving said platform with the belled heat exchanger vertically to an expansion station; and selecting appropriate expanding rods for the heat exchanger configuration and expanding the tubes of the partially assembled multi-row heat exchanger into the plate fins one row at a time.

2. A method as set forth in claim 1 wherein the step of expanding the rows of the heat exchanger further comprises receiving in a hairpin receiver the back end of a row at a time of hairpin tubes and expanding the tubes one row at a time.

3. A method as set forth in claim 1 wherein the step of expanding the rows of the heat exchanger further comprises gripping the belled end of the tubes one row at a time and inserting the selected expanding rods into the tube of the multi-row heat exchanger one row at a time to tension expand the tubes into the plate fins.

4. A method as set forth in claim 3 wherein the step of expanding further comprises receiving the back end of an aluminum hairpin tube to be expanded in a hairpin receiver to prevent the hairpin tube from elongating during tension expansion.

5. A method as set forth in claim 3 wherein the step of expanding further comprises gripping the back end of a copper tube to be expanded in a gripper to prevent the copper tube from shrinking longitudinally during tension expansion.

6. An apparatus for belling and expanding copper and aluminum tubes having front and back ends into a plurality of laced plate fins and at least one tube sheet to form a multi-row plate fin heat exchanger comprising:

support means for supporting the laced plate fin heat exchanger for vertical movement between a belling means and an expanding means, said support means including a first adjustment means for adjusting the support means to the width of the heat exchanger, a second adjustment means for adjusting the support means to the length of the heat exchanger, a clamp means for clamping the sides of the tube sheet, and a jacking means for moving the supported laced plate fin heat exchanger vertically between said first belling means and said expanding means;

a first movable tool carriage means having a first belling mans for simultaneously belling an entire single row of tubes of the multi-row plate fin heat exchanger one row at a time, and an expanding means for simultaneously expanding an entire single row of one row of belled tubes one row at a time into contact with the tube sheet and the plate fins of the multi-row plate fin heat exchanger, said first movable tool carriage means located adjacent the front end of the tubes; and a second movable tool carriage means located adjacent the back end of the tubes having a first receiver means to contact each entire single row of tubes one row at a time as the first belling means bells each entire single row, and a second receiver means to contact each entire single row of tubes one row at a time as the expanding means expands each entire single row.

7. An apparatus as set forth in claim 6 wherein said expanding means includes a plurality of gripping tools for simultaneously gripping the belled end of an entire single row of belled tubes, and a plurality of selectable expanding rods for tension expanding an entire single row of tubes of the multi-row heat exchanger one row at a time.

* * * * *